US005496078A

United States Patent [19]

Yasuda

[11] Patent Number: 5,496,078

[45] Date of Patent: Mar. 5, 1996

[54] FLUSH HANDLE ASSEMBLY

[75] Inventor: Sachio Yasuda, Tokyo, Japan

[73] Assignee: Takigen Manufacturing Co. Ltd., Tokyo, Japan

[21] Appl. No.: 197,066

[22] Filed: Feb. 16, 1994

[30] Foreign Application Priority Data

May 27, 1993 [JP] Japan ..... 5-148646

[51] Int. Cl.[6] ..... E05C 1/12

[52] U.S. Cl. ..... 292/165; 292/169; 292/DIG. 31

[58] Field of Search ..... 292/165, 169, 292/170, 140, 145, 336.3, DIG. 31, DIG. 37

[56] References Cited

U.S. PATENT DOCUMENTS

| | | | |
|---|---|---|---|
| 2,657,085 | 10/1953 | Dedoes | 292/169 |
| 2,780,485 | 2/1957 | Dedoes | 292/169 |
| 2,874,986 | 2/1959 | Henrichs | 292/DIG. 31 X |
| 4,693,503 | 9/1987 | Bisbing | 292/DIG. 53 X |
| 4,882,919 | 11/1989 | Craig | 292/165 X |
| 4,895,403 | 1/1990 | Osenkowski | 292/DIG. 31 X |

*Primary Examiner*—Steven N. Meyers
*Assistant Examiner*—Monica E. Millner
*Attorney, Agent, or Firm*—Martin Smolowitz

[57] ABSTRACT

A flush handle assembly itself and a stationary frame 36 can be prevented from being damaged even when a door 35 is opened and closed in a condition in which a front end of a latch 30 is projected from the door 35. In the assembly: a handle 9 has its base end pivoted to side walls 3 of a casing 1 through a pivot 18; a leaf spring 19 keeps the handle 9 in position and urges the same to be projected from or retracted in the casing 1; the latch 30 is received in a latch casing 24 and is urged by a spring 33 to move forward; a control projection 17 of a rear surface of the handle 19 is abutted on an oblique-plate portion 32 of a side surface of the latch element 30; the projection 17 of the handle 19 is moved back and forth as the handle 19 is projected or retracted, so that the latch 30 is slidably moved horizontally along guide portions 28, 29 of the latch casing 24.

5 Claims, 5 Drawing Sheets

FLUSH HANDLE ASSEMBLY

BACKGROUND OF THE INVENTION

1. Field of the Invention

The present invention relates to a flush handle assembly for locking up a door.

2. Description of the Prior Art

In a conventional flush handle assembly, a handle is received in a front concave portion of a casing so as to be projected therefrom and retracted in the front concave portion. The casing is fixedly mounted on a door. In operation, when the handle is swung so as to be projected from the front concave portion of the casing, a catch plate mounted on a rear surface side of the casing is also swung so that a front-end portion of the catch plate is engaged with or disengaged from a receiving portion of a stationary frame element, whereby the door is locked up.

However, in the conventional flush handle assembly, when the door is opened or closed in a condition in which the front-end portion of the catch plate is projected from an edge portion of the door, there is a fear that the front-end portion of the catch plate hits an edge portion of the stationary frame element to damage both the flush handle assembly itself and the stationary frame element.

SUMMARY OF THE INVENTION

It is an object of the present invention to provide a flush handle assembly which may prevent both the assembly itself and a stationary frame element from being damaged, even when a door is opened and closed in a condition in which a front-end portion of a latch element is projected from an edge portion of the door.

The above object of the present invention are accomplished by providing:

a flush handle assembly comprising:

a casing for fixedly mounting on a door;

a handle having its base-end portion pivoted to a side wall of the casing through a cross pivot, the handle being retractable in a front concave portion of the casing;

a leaf spring for keeping a position of the handle and for urging the same to be projected from and retracted in the front concave portion of the casing, the leaf spring being interposed between the handle and a bottom portion of the front concave portion of the casing;

a control projection fixedly mounted on a rear surface of the handle;

a latch casing fixedly mounted on a rear surface of the casing, the latch casing being provided with guide portions in its opposite side walls;

a latch element which is provided with an oblique portion in its front-end portion and has its oblique-plate portion projected from its side surface; and a biasing spring for urging the latch element forward;

wherein: the latch element has its oblique-plate portion abut against the control projection; the handle is projected from or retracted in the front concave portion of the casing so as to have the control projection move back and forth, so that the latch element is slidably moved horizontally along the guide portions of the latch casing, whereby the front-end portion of the latch element is engaged with and disengaged from a receiving portion of a stationary frame element.

DESCRIPTION OF THE PREFERRED EMBODIMENTS

Figure 1:
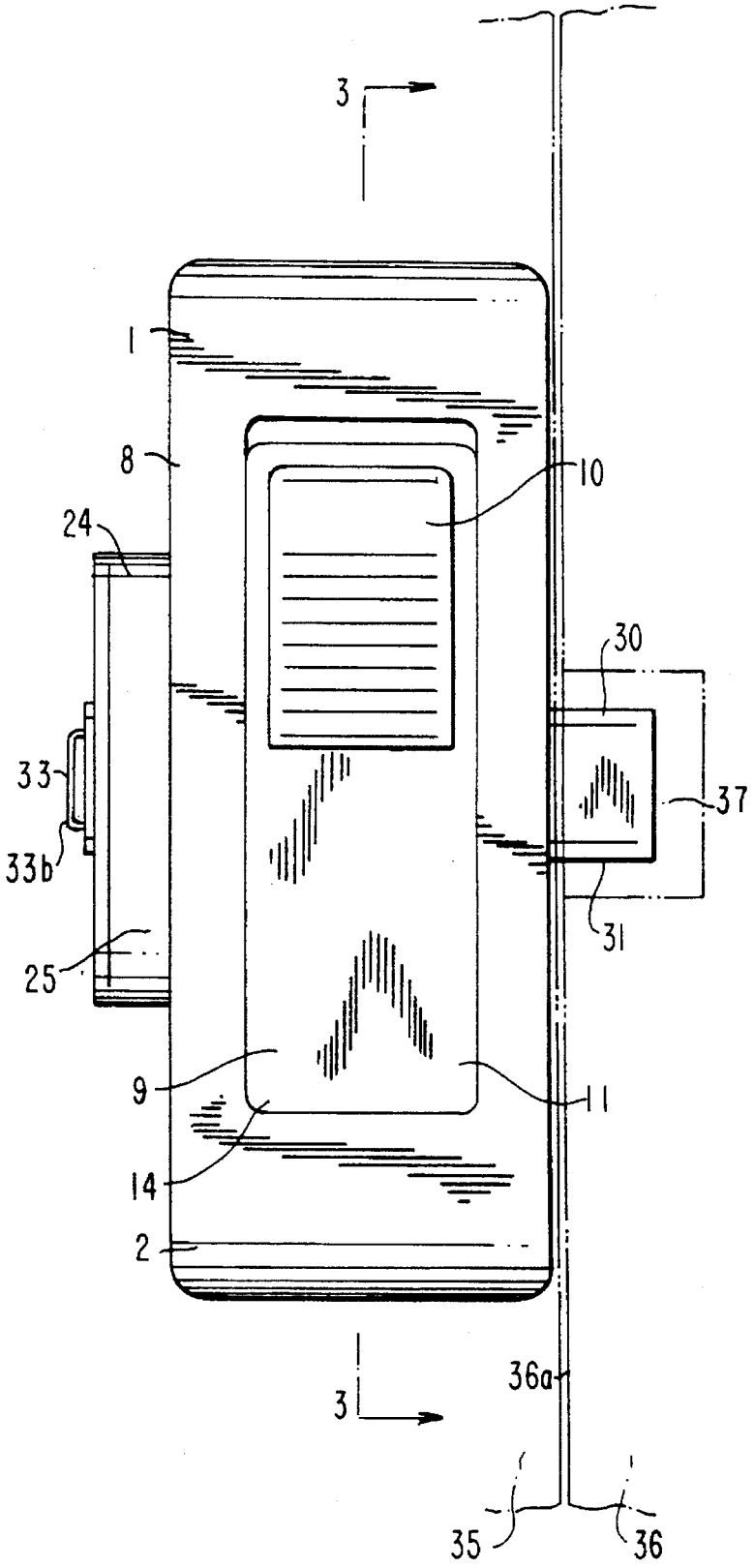
FIG. 1 is a front view of an embodiment of the flush handle assembly of the present invention.

Hereinbelow, the present invention will be described in detail with reference to the accompanying drawings and the reference numerals and characters.

In a flush handle assembly of the present invention, a casing 1 is fixedly mounted on a door 35. A flush handle 9 has its base-end portion pivoted to a side wall 3 of the casing 1 through a cross pivot 18, and is retractable in a front concave portion 2 of the casing 1.

A leaf spring 19, which keeps the handle 9 in position and urges the handle 9 to be projected from and retracted in the front concave portion 2 of the casing 1, is interposed between the handle 9 and a bottom portion **2*a* of the front concave portion 2 of the casing 1. A control projection 17 is fixedly mounted on a rear surface of the handle 9**.

A latch casing 24 is fixedly mounted on a rear surface of the casing 1. The latch casing 24 is provided with guide portions 28, 29 in its opposite side walls **26*a*, 26*b*. A latch element 30 is provided with an oblique portion in its front-end portion 31, and has its oblique-plate portion 32 projected from its side surface. A biasing spring 33 urges the latch element 30 forward in the lath casing 24. In the flush handle assembly of the present invention having the above construction, the latch element 30 has its oblique-plate portion 32 abut against the control projection 17. The handle 9 is projected from or retracted in the front concave portion 2 of the casing 1 by action of the leaf spring 19 so as to have the control projection 17 move back and forth, so that the latch element 30 is slidably moved horizontally along the guide portions 28, 29 of the latch casing 24 and substantially perpendicular to the casing 1, whereby the front-end portion 31 of the latch element 30 is engaged with and disengaged from a receiving portion 37 of a stationary frame element 36 for locking and unlocking the door 35**.

Figure 2:
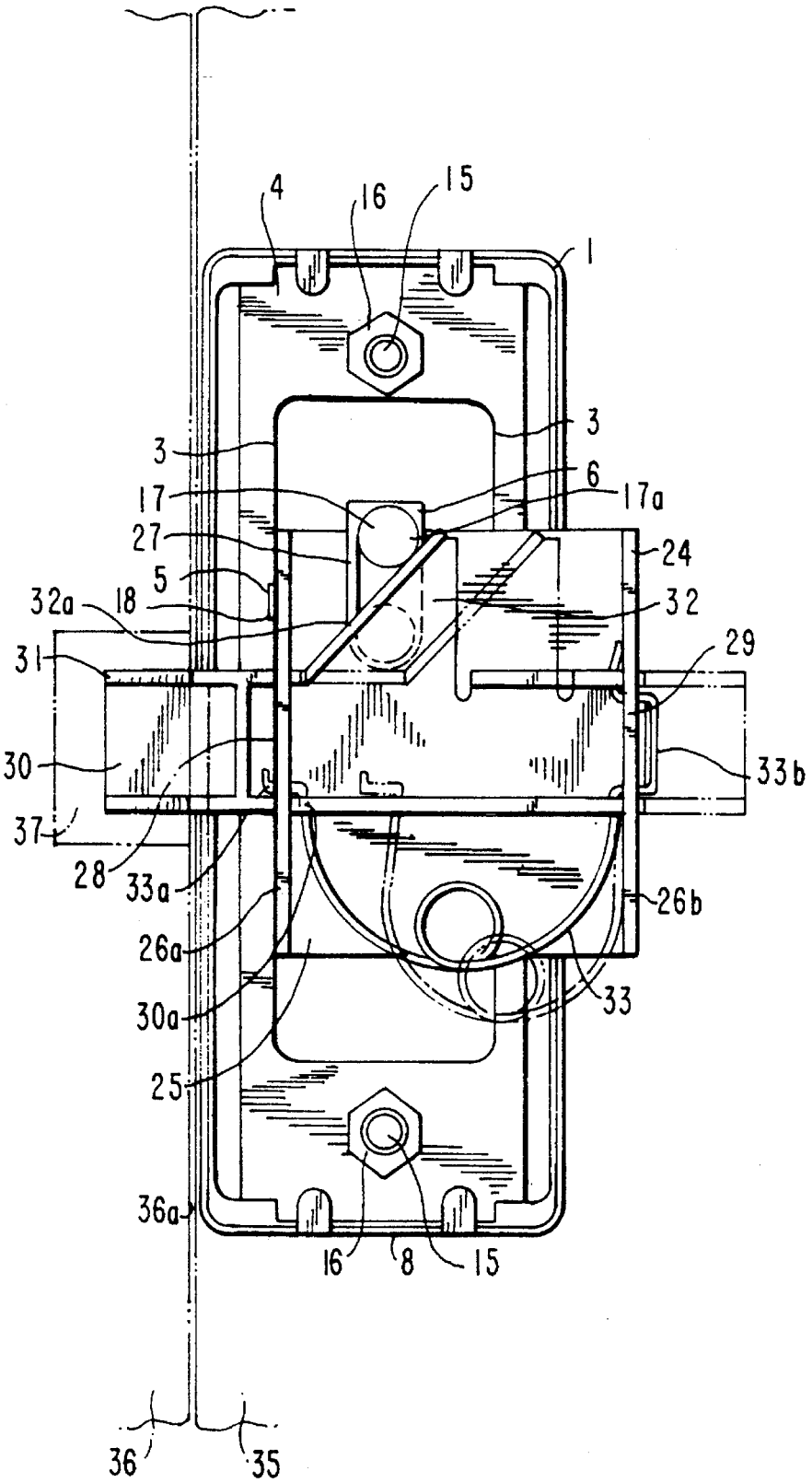
FIG. 2 is a rear view of the flush handle assembly of the present invention shown in FIG. 1.
Figure 3:
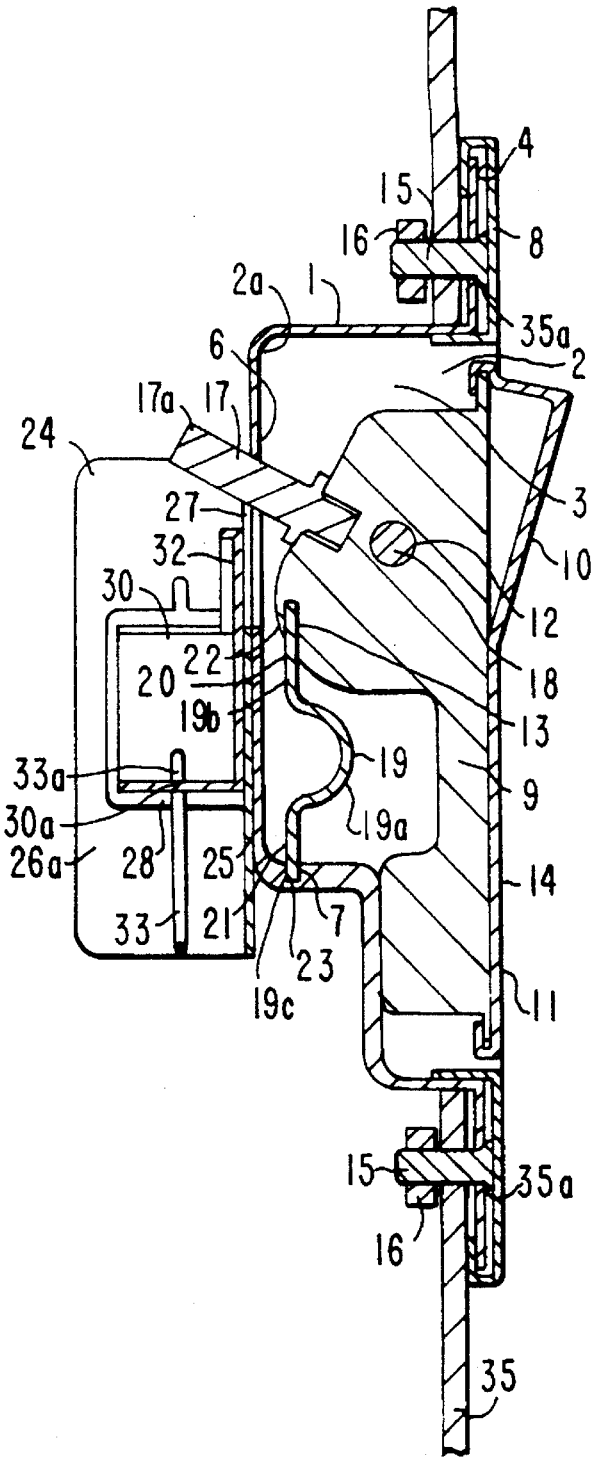
FIG. 3 is an sectional view of the flush handle assembly of the present invention, taken along the line A—A of FIG. 1.

As shown in FIGS. 2 and 3, the latch element 30 is urged by the biasing spring 33 to have its oblique-plate portion 32 abut against a front-end portion **17*a* of the control projection 17. When a push-button portion 10 of the handle 9 is depressed by a user and the handle 9 is swung to project from the casing 1 so that the control projection 17 is moved forward, the oblique-plate portion 32 of the latch element 30 abuts against the control projection 17 of the handle 9 and is urged by the same projection 17 to slidably move back against a resilient force exerted by the biasing spring 33. When the handle 9 is further swung on the cross pivot 18, the handle 9 is held in its projecting position by the leaf spring 19. At the same time, the front-end portion 31 of the latch element 30 is retracted in the latch casing 24, so that the door 35 is unlocked and released from the stationary frame element 36**.

When the door 35 is locked up relative to the stationary frame element 36, the door 35 is closed. Then, a front-end portion 11 of the handle 9 is depressed so that the handle 9 is immediately swung rearward under the influence of a resilient force exerted by the leaf spring 19, so that the control projection 17 of the handle 9 is moved back and upwardly. At the same time, the latch element 30 is moved forward by the biasing spring 33 so that the front-end portion 31 of the latch element 30 is projected from the latch casing 24 and engaged with the receiving portion 37 of the stationary frame element 36.

After the door 35 is opened, when the door 35 is to be closed in a condition in which the front-end portion 31 of the latch element 30 is projected from the latch casing 24 and the handle 9 is retracted in the casing 1, the front-end oblique portion 31 of the latch element 30 hits an edge portion 36*a* of the stationary frame element 36 to urge the latch element 30 to be retracted in the latch casing 24. When the front-end portion 31 of the latch element 30 clears the edge portion 36*a* of the stationary frame element 36, the latch element 30 is moved forward under the influence of the resilient force exerted by the biasing spring 33, so that the latch element 30 is engaged with the receiving portion 37 of the stationary frame element 36.

The first embodiment of the present invention is shown in FIGS. 1 to 3. A cover member 8 is fixedly mounted on an upper surface of each of upper and lower flange portions 4 of the elongated casing 1. Another cover member 14 is also fixedly mounted on an upper-surface portion of the handle 9. The cover member 14 is provided with the push-button portion 10 in its base-end portion. A bolt 15 is fixed to a rear surface of each of the upper and lower flange portions 4. The door 35 is provided with a plurality of through-holes 35*a*. The bolt 15 passes through the door 35 from its front side to its rear side, and the bolt has its front-end portion threadably engaged with a nut 16, so that the flush handle assembly of the present invention is fixedly mounted on the door 35.

Axial holes 5 are formed in opposite side walls of the front concave portion 2 of the casing 1. Another axial hole 12 is formed in the base-end portion of the handle 9. Consequently, the handle 9 is pivoted to the casing 1 through the cross pivot 18 passing through these through-holes 5 and 12. The control projection 17 is threadably engaged with the rear portion of the handle 9, and has its front-end portion 17*a* projected from an elongated hole 6 of the bottom surface of the casing 1.

The leaf spring 19, which is interposed between the handle 9 and the bottom portion 2*a* of the front concave portion 2 of the casing 1 so as to keep in position and urge the handle 9 to be projected from the casing 1, has its central portion 19*a* formed into a semicircular shape, and has its opposite end portions 19*b* and 19*c* formed into flat-plate portions 20 and 21, respectively. The flat-plate portions 20 and 21 of the leaf spring 19 are provided with lip segments 22 and 23 in their front end, respectively. The lip segments 22 and 23 of the leaf spring 19 are engaged with spring-support portions 13 of the handle 9 and 7 of the casing 1, respectively.

The latch casing 24 is fixedly mounted on the rear surface of the casing 1, and constructed of an upper plate portion 25 and opposite side plate portions 26*a*, 26*b*. In the upper plate portion 25, there is formed an elongated hole 27 through which the control projection 17 of the handle 9 is projected outward. In the opposite side plate portions 26*a* and 26*b* of the latch casing 24, there are provided the guide portions 28 and 29 for guiding the latch element 30, respectively. The latch element 30 is slidably mounted in these guide portions 28, 29 of the latch casing 24. The oblique portion is provided in the front-end portion 31 of the latch element 30. The oblique-plate portion 32 of the latch element 30 projects outward from its side surface, and has its oblique portion 32*a* abut against the front-end portion 17*a* of the control projection 17 under the influence of the resilient force exerted by the biasing spring 33 which is constructed of a coil spring 33, so that the latch element 30 is urged forward. The coil spring 33 has one portion 33*a* of its opposite end portions 33*a*, 33*b* engaged with an engaging portion 30*a* of the latch element 30 and has the remaining one portion 33*b* engaged with portion 24*a* of the side wall 26*b* of the latch casing 24.

Figure 4:
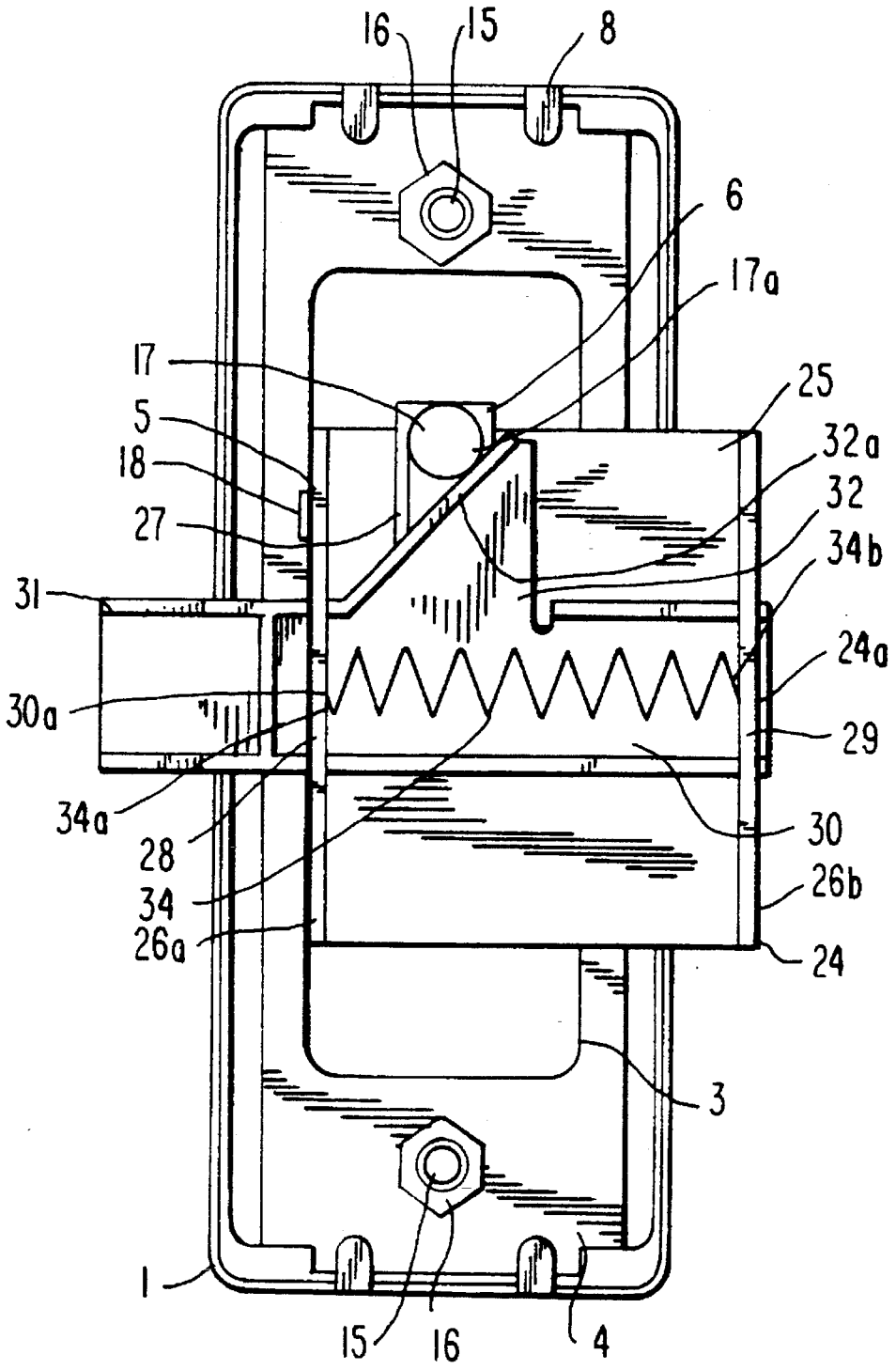
FIG. 4 is a rear view of another embodiment of the flush handle assembly of the present invention.
Figure 5:
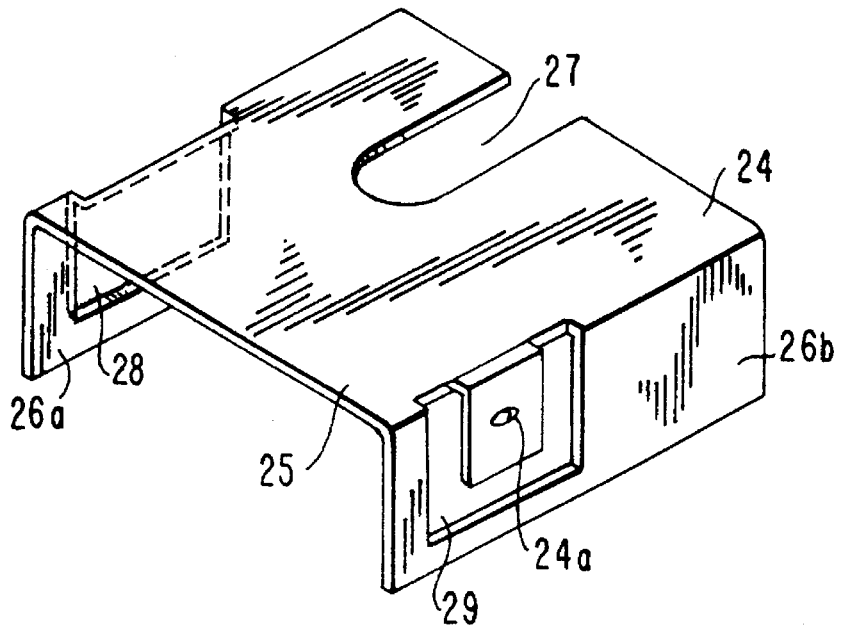
FIG. 5 is a perspective view of the latch casing of the flush handle assembly of the present invention.
Figure 6:
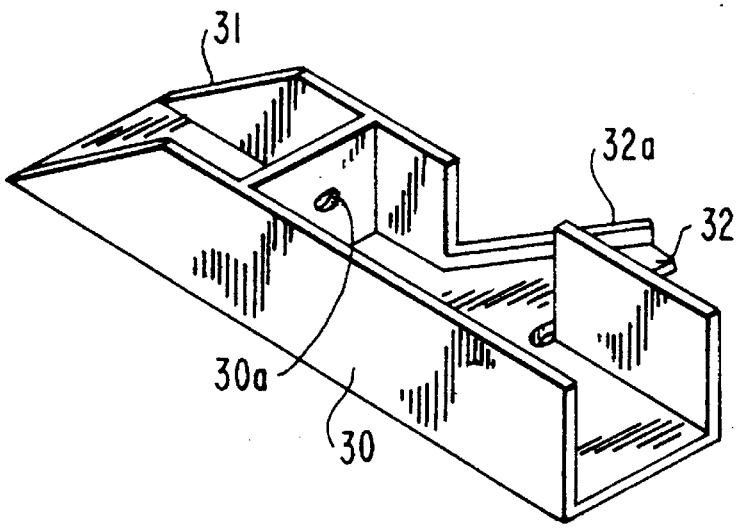
FIG. 6 is a perspective view of the latch element of the flush handle assembly of the present invention.

Another embodiment of the present invention is shown in FIGS. 4 to 6. In the another embodiment, a compression spring 34 is used in place of the coil spring 33 as the biasing spring of the embodiment shown in FIGS. 1 to 3. The compression spring 34 has its opposite end portions 34*a* and 34*b* engaged with the engaging portion 30*a* of the latch element 30 and an engaging portion 24*a* of the latch casing 24, respectively. Consequently, the latch element 30 is urged forward by the compression spring 34.

As described above, in the flush handle assembly of the present invention: the handle 9 is pivoted to the casing 1 through the cross pivot 18; the leaf spring 19 is interposed between the handle 9 and the bottom portion 2*a* of the front concave portion 2 of the casing 1 to keep in position and urge the handle 9 to project outward from the casing 1; the control projection 17 is fixedly mounted on the rear surface of the handle 9; the latch casing 24 is fixedly mounted on the rear surface of the casing 1; the latch element 30, which is provided with the oblique portion in its front-end portion 31 and has its oblique-plate portion 32 project from its side surface outward, is slidably received in the guide portions 28, 29 of the latch casing 24 and urged forward by the biasing spring 33 or 34 to have its oblique-plate portion 32 abut against the control projection 17; the control projection 17 is moved back and forth as the handle 9 is projected from and retracted in the casing 1, so that the latch element 30 is slidably moved in the guide portions 28, 29 of the latch casing 24, whereby the front-end portion 31 of the latch element 30 is engaged with and disengaged from the receiving portion 37 of the stationary frame element 36 so as to lock up and unlock the door 35. In the flush handle assembly of the present invention having the above construction, even when the door 35 is closed in a condition in which the front-end portion 31 of the latch element 30 is projected from the side surface of the door 35, there is no fear that both of the flush handle assembly itself and the stationary frame element 36 are damaged since the front-end portion 31 of the latch element 30 is retracted in the latch casing 24 when the front-end portion 31 of the latch element 30 hits the edge portion 36*a* of the stationary frame element 36.

What is claimed is:

1. A flush handle assembly, comprising;

a casing (1) for fixedly mounting on a door (35)

a handle (9) having its base-end portion pivoted to a side wall (3) of said casing (1) through a cross pivot (18), said handle (9) being retractable in a front concave portion (2) of said casing (1);

a leaf spring (19) for keeping a projected or retracted position of said handle (9) and for urging the handle to be projected from and retracted in said front concave portion (2) of said casing (1), said leaf spring (19) being interposed between said handle (9) and a bottom portion (2*a*) of said front concave portion (2) of said casing (1);

a control projection (17) fixedly mounted on a rear surface of said handle (9);

a latch casing (24) fixedly mounted on a rear surface of said casing (1), said latch casing (24) being provided with guide portions (28, 29) in its opposite side walls (26*a*, 26*b*);

a latch element (30) which is provided with an oblique portion in its front-end portion (31) and has its oblique-plate portion (32) projected from its side surface, said latch element (30) being oriented substantially perpendicular to said casing (1);

a biasing spring (33,34) provided between said latch casing (24) and said latch element (30) for urging said latch element (30) forward;

wherein said latch element (30) has its oblique-plate portion (32) abut against said control projection (17); said handle (9) is projected from or retracted in said front concave portion (2) of said casing (1) so as to have said control projection (17) move back and forth, so that said latch element (30) is slidably moved horizontally along said guide portions (28, 29) of said latch casing (24), whereby said front-end portion (31) of said latch element (30) can be engaged with and disengaged from a receiving portion (37) of a stationary frame element (36).

2. The flush handle assembly according to claim 1, wherein a central portion of said casing (1) is capable of being inserted into an opening in a door (35), upper and lower flange portions of said casing (1) are adapted to be fixedly mounted onto a front side of a door (35), and a cover member (8) covers the upper and lower flange portions of the casing (1).

3. The flush handle assembly according to claim 1, wherein said handle (9) is covered by a cover member (14) which is provided with a push button portion (10) located at a base end portion of the cover member (14).

4. The flush handle assembly according to claim 1, wherein said biasing spring is a coil type spring (33).

5. The flush handle assembly according to claim 1, wherein said biasing spring is a compression type spring (34).

* * * * *